United States Patent [19]

Gates

[11] Patent Number: 4,899,978

[45] Date of Patent: Feb. 13, 1990

[54] LOCKING BRACKET FOR HOLDING TIE ROD ENDS

[75] Inventor: H. Gordon Gates, Lakewood, Colo.

[73] Assignee: Gates & Sons, Inc., Denver, Colo.

[21] Appl. No.: 285,406

[22] Filed: Dec. 16, 1988

[51] Int. Cl.[4] ..... E04G 17/08

[52] U.S. Cl. ..... 249/219.2; 249/46

[58] Field of Search ..... 249/219.2, 46, 213, 249/25

[56] References Cited

U.S. PATENT DOCUMENTS

| | | | |
|---|---|---|---|
| 3,018,538 | 1/1962 | Gates | 249/219 W |
| 3,529,800 | 9/1970 | Gates | 249/219 |
| 3,625,471 | 12/1971 | Eriksson | 249/219.2 |
| 3,693,931 | 9/1972 | Holt | 249/219.2 |
| 3,822,859 | 7/1974 | Buyken et al. | 249/219.2 |
| 4,219,180 | 8/1980 | Strickland | 249/219.2 |
| 4,304,388 | 12/1981 | Gates | 249/219 W |

*Primary Examiner*—James C. Housel

*Attorney, Agent, or Firm*—Fields, Lewis, Pittenger & Rost

[57] ABSTRACT

A form tie lock is provided which is releasably locked in an open position and swings over center to a closed position. A ramp is provided on an opening through which a form tie loop extends in order to compensate for any deflection of the claw of the form tie lock due to pressure exerted thereon by the form tie so that the lock will swing past the opening into locked position. Suitable recesses and detents are provided for mounting the lock on walers or other mounting surfaces. Also an arcuate reinforcing rib is provided on the plate to minimize bending or fracture thereof.

4 Claims, 3 Drawing Sheets

LOCKING BRACKET FOR HOLDING TIE ROD ENDS

TECHNICAL FIELD

This invention relates to a form tie lock and in particular to such a lock which can be utilized in different orientations and will remain in a preselected position during installation of the form ties.

BACKGROUND ART

In the formation of concrete wall structures, various types of tools have been utilized. A tool which has been very satisfactory for use with gang form panels is disclosed in my U.S. Pat. No. 3,529,800 for "Concrete Form Tie End Latch" issued on Sept. 22, 1970.

When hand set panels are required, a second tool can be utilized which is releasably mounted on a whaler to facilitate the dismembering of the hand set panel after the concrete hardens. Such a tool is disclosed in my U.S. Pat. No. 3,018,538 for "Combined Tie Lock and Reinforcing Timber Clamp" which issued on Jan. 30, 1962. A dual purpose form lock tie which can be used for either gang form panels or hand set panels is disclosed in my U.S. Pat. No. 4,304,388 for "Duel Purpose Form Tie Lock Tool" which issued on Jan. 8, 1981.

Each of these tools has been satisfactory for its intended purpose. However, some inherent shortcomings have been recognized which the present invention is intended to overcome. One difficulty which has been encountered is that the locks tend to want to swing toward a closed position across the form tie opening if the frictional resistance at the pivot post is insufficient to hold the lock in open position. Thus, it requires a workman on each side of the forms for insertion of a form tie so that one can insert the form tie from one side of the form and the other can manipulate the lock from the other side of the form. Also, the plate to which the lock is attached is only usable in one orientation whereas certain job sites require more than one orientation of the base plate. Additionally, the plate upon which the latch is mounted will sometimes fracture if overloaded. Finally, sometimes a load on the form tie will deflect the claw of the latch toward the form tie opening to a sufficient extent that it engages the plate at the side of the opening and does not readily slide across the opening so that it can be closed.

DISCLOSURE OF THE INVENTION

In accordance with this invention a form tie lock has been provided for use with form panels, reinforcing walers and a form tie. The lock includes a base plate mountable on a reinforcing waler on a form panel and having an opening for receiving the loop end of the form tie. Attachment means are provided on the base plate for attaching the base plate to the waler. A post extends from the base plate and is spaced from the opening. A latch member is pivotally mounted on the post and has a tapered claw with a tip which is movable across the opening from an open position on a first side to a closed position on the second side to grippingly engage the loop end of a form tie to hold the form tie between the form panels. A ramp surface is provided on the second side of the opening for guiding the tip of the claw up onto the plate after the tip passes through the loop end. The tie lock also includes an arcuate reinforcing rib in the plate on the opposite side of the opening from the post for reinforcement purposes. A stop projects from the plate to be engage by the latch member when it is swung to the open position on the first side to prevent the latch member from swinging into an unwanted position across the opening. Releasable means is provided for releasably holding the latch member in the open position. A stop is located so that the latch member is over center when in contact therewith so that the latch member cannot swing over the opening under the influence of gravity. The releasable means can include a bump on the plate and a recess on the latch which frictionally engage each other to hold the latch means in the predetermined selected position.

The form tie as just described has the advantage of being relatively lightweight, inexpensive to manufacture and effective in operation wherein it can releasably locked in an open position and moved over center to a closed position when in use.

Additional advantages of this invention will become apparent when taken in conjunction with the accompanying drawings and description which follows:

BEST MODE FOR CARRYING OUT THE INVENTION

Figure 4:
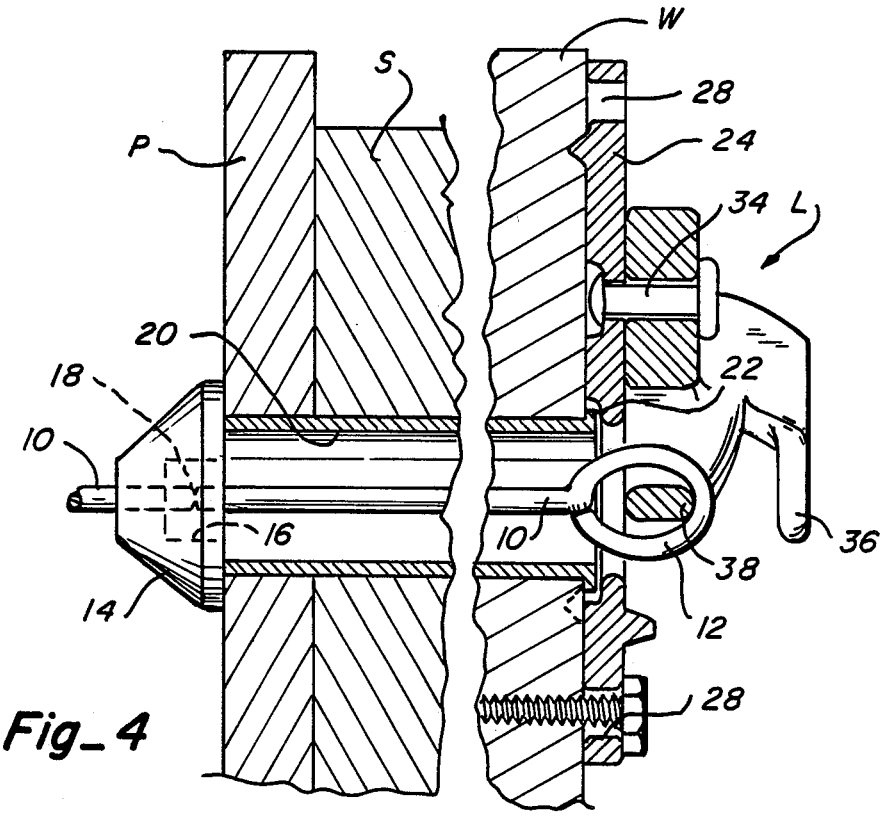
FIG. 4 is an enlarged vertical section, taken along 4—4 of FIG. 1, showing the form tie lock of this invention in engagement with the loop of a form tie.

In accordance with this invention, a pair of spaced, vertical form panels P have transverse vertical stringers S attached thereto onto which are mounted vertical walers W. A plurality of form ties 10 extend through openings in the walers and have a loop 12 for locking them into position, as will be described below. Plastic cones 14 are provided over form ties 10 at the innerface with form panels P and have a recess 16, as shown in FIG. 4. A notch 18 is provided in each form tie 10 within this recess so that the ends of the form ties can be twisted off after the concrete between the form panels has set, all as well known in the concrete forming industry. A plastic sleeve 20 extends through the walers, stringers and form panels and has a lip 22 which positions the tube so that the opposite end is flush with the inside face of the form panel P.

The form tie locks L can be mounted on walers W in a vertical orientation or a horizontal orientation, as will be described below. The first orientation is illustrated in FIGS. 1–4. The form lock tie L comprises a base plate 24 which can be attached to the waler W as shown, as by nails inserted through openings 26 provided in each corner of base plate 24. Also a larger opening 28 can be provided along the upper and/or lower edges of plate 24 for receiving a lag bolt, if desired. The backside of plate 24 has three anchoring points 30 which are pressed into the waler when the plate is nailed in place to prevent inadvertent rotation or movement of the plate and form tie lock with respect to the waler.

A latch member 32 is pivotally mounted on a post 34 extending from the front side of the base plate 24. This latch member includes an arm 36 and an arcuate claw 38 which can be swung by arm 36 across an opening 40 through which form tie loop 12 extends, as shown in FIG. 4 for engagement by the claw 38. A ramp 42 is formed in the side edge of opening 40 across which claw 38 moves after it receives loop 12. The purpose of this ramp is to guide the point of the claw up onto the surface of plate 24 if the claw is under load due to its engagement with loop 12 which deflects it toward the plate so that it would not clear the side of the opening when closing.

Plate 24 is also provided with an arcuate rib 44 on the side of opening 40 which is opposite post 34 which minimizes flexture and cracking of plate 22 under a load.

Figure 1:
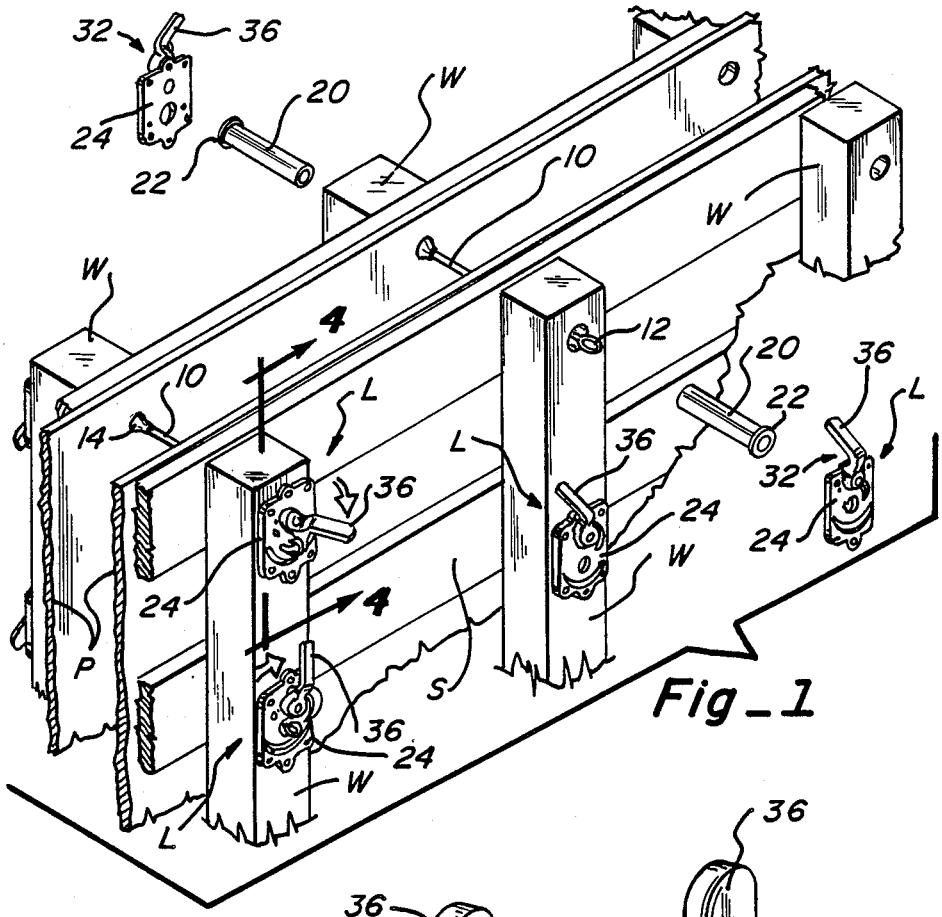
FIG. 1 is a fragmentary, perspective, exploded view of form panels with form ties utilizing the form tie lock of this invention.
Figure 2:
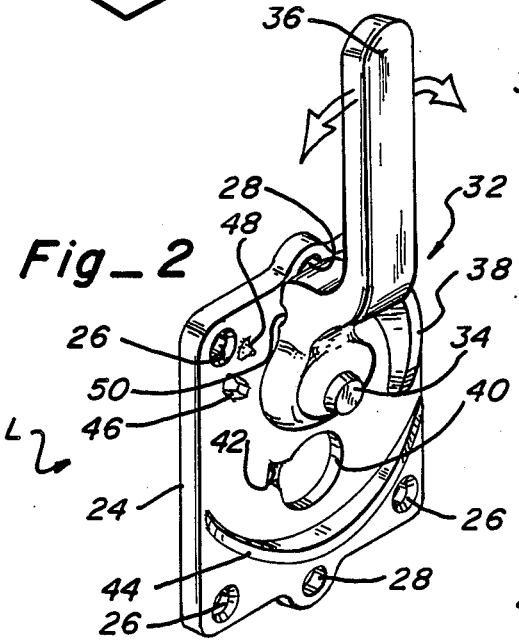
FIG. 2 is an enlarged perspective view of the front of a form tie lock of FIG. 1 in vertical orientation.
Figure 3:
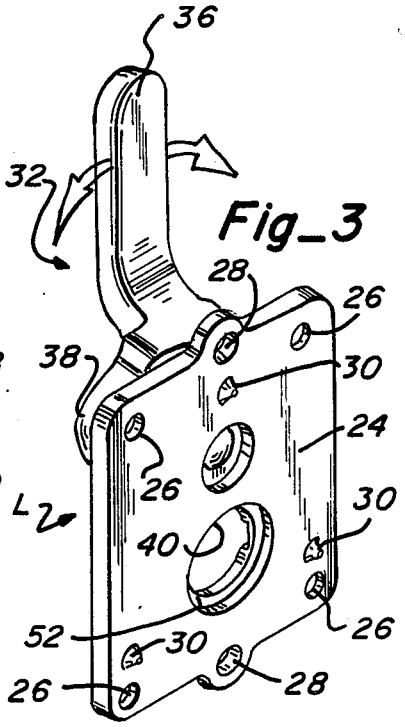
FIG. 3 is a back perspective view of the form tie lock of FIG. 2.
Figure 5:
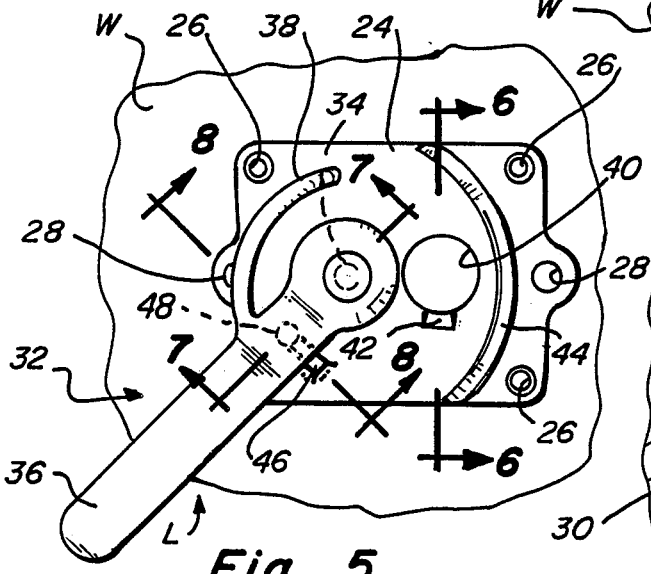
FIG. 5 is a front elevational view of the form tie lock of FIG. 2, but in horizontal orientation and with the latch member in open locked position.
Figure 6:
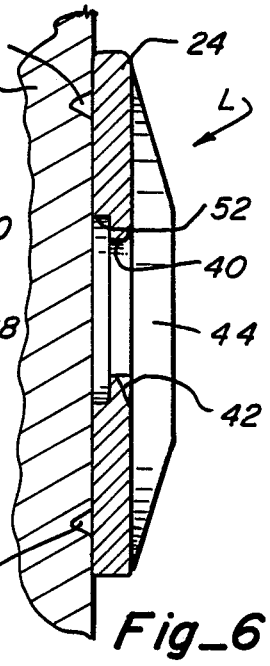
FIG. 6 is an enlarged vertical section, taken along line 6—6 of FIG. 5, showing the ramp on the edge of the form tie opening for guiding the claw of the latch member.
Figure 7:
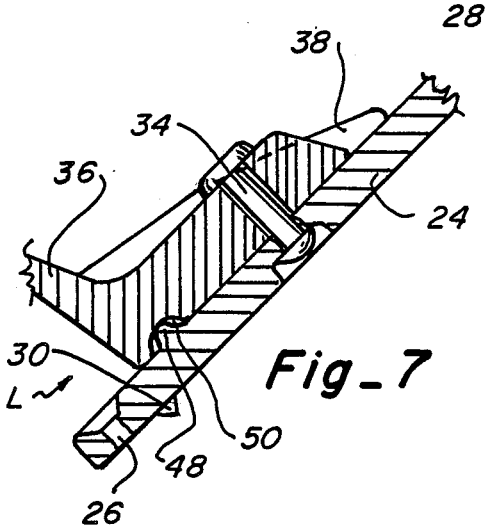
FIG. 7 is an enlarged transverse section, taken along line 7—7 of FIG. 5, showing the latch member releasably engaging a locking bump.
Figure 8:
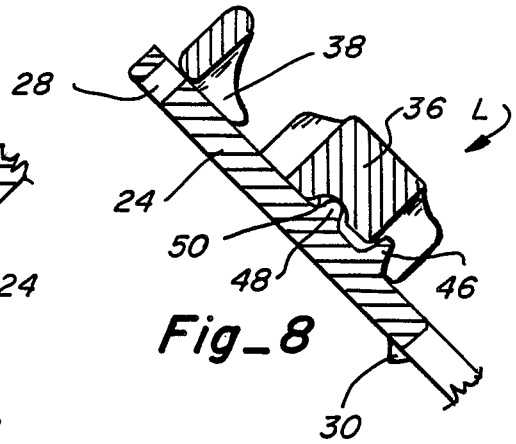
FIG. 8 is transverse section, taken along line 8—8 of FIG. 5, showing further details of the locking bump and latch member.
Figure 9:
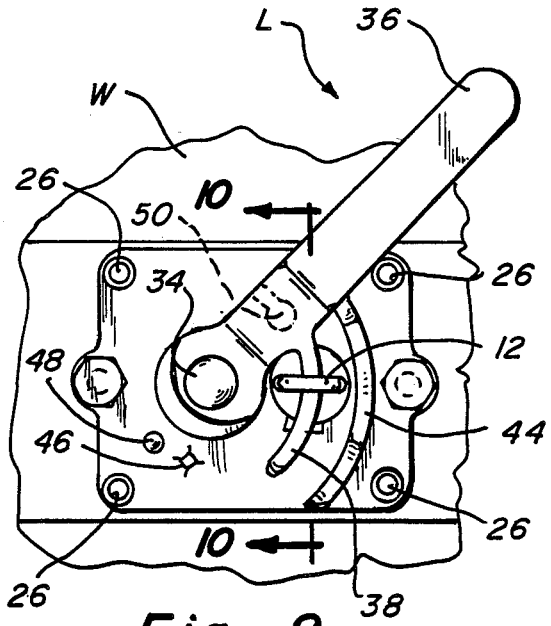
FIG. 9 is a side elevation, similar to FIG. 5, but showing the latch member in a second closed position engaging the loop of a form tie.
Figure 10:
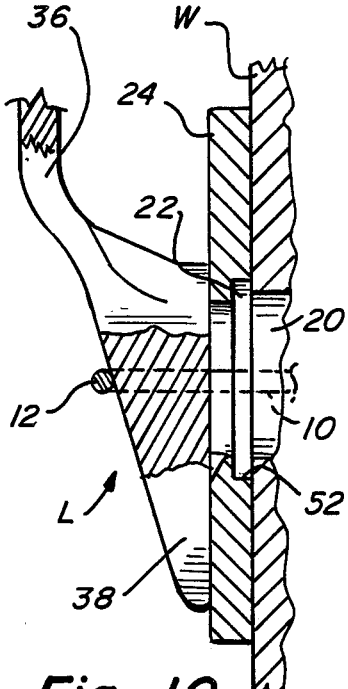
FIG. 10 is an enlarged vertical section, taken along line 10—10 of FIG. 9, showing the claw of the latching member engaging the loop end of the form tie.

The remaining features of this invention can be best understood by referring to FIGS. 5–10 wherein latch member 32 is rotated 90° in a counterclockwise direction from the vertical position shown in FIGS. 1–4 to a horizontal position. The latch member 32 is in the open position as viewed in FIG. 5 and moves from this position to the closed position shown in FIG. 9 in order to engage loop 12 of a form tie. When in the open position shown in FIG. 5, the side of arm 36 engages a stop 46 when the latch member is in the open position, as shown in FIG. 5. Also when in this position, it is releasably latched or held in position by a detent bump 48 on plate 24 which is received in a recess 50 on the bottom of handle 36, as best seen in FIGS. 7 and 8. In order to close the latch, arm 36 is grasped by a hand or struck by a hammer to move it away from detent bump 48 and pivot it to the closed position shown in FIG. 9 wherein claw 38 is engagement with loop 12. Thus, the stop 46 prevents the handle from moving downwardly any further when in the open position and gravity as well as the stop tend to hold it in the open position. To move it to the closed position it must move in a clockwise direction over center with respect to pivot pin 36. This is also true when the device has the vertical orientation as shown in FIGS. 2 and 3. When in the open position, the handle will be supported and prevented from further counterclockwise rotation by means of stop 46 and will be latched in that position by detent bump 48. In addition, when pivoted in a clockwise position over center about the axis of pivot pin 34 it can be moved into the closed position wherein claw 38 moves past opening 40 and engages loop 12 of the form tie. Conveniently, the opening 40 has an enlarged recess 52 for receiving the lip 22 of tube 20. Thus, the plate 24 will fit flat against waler W.

From the foregoing, the advantages of this invention are readily apparent. The form tie lock, as described, has the advantage of being mountable in either of two different orientations and has a mounting plate which is lightweight, yet strong. The mounting plate has a ramp to accommodate any deflection of the claw of the latch member so that it rides across the opening and easily and effectively secures the loop end of the form tie. The latch means has a releasable latch and a stop to hold the latch means in a position on one side of the opening so that it cannot accidentally close and can only move to closed position after moving over center.

This invention has been described in detail with reference to a particular embodiment thereof, but it will be understood that various other modifications can be effected within the spirit and scope of this invention.

I claim:

1. A form tie lock for use with form panels, reinforcing walers and a form tie, said lock comprising;

a base plate, mountable on a reinforcing waler on a form panel, having an opening with a peripheral edge for receiving the loop end of a form tie;

attachment means on said base plate for attaching said base plate to the waler;

a post extending from said base plate and spaced from said opening;

a latch member pivotally mounted on said post having a tapered claw with a tip which is movable across said opening from an open position on a first side of said opening to a closed position on a second side of said opening to grippingly engage a loop end of a form tie to hold the form tie in position between the form panels; and a ramp surface formed in said peripheral edge of said second side of said opening and inclined away from said opening for guiding said tip of said claw up onto said plate after said tip passes through the loop end and is deflected thereby toward said opening.

2. A lock, as claimed in claim 1, further including:

a curved circular portion of said claw having a radius about said post as a center; and an arcuate reinforcing rib in said plate on an opposite side of said opening from said post which is generally concentric to said curved portion of said claw and has a radius about said post as a center.

3. A form tie lock for use with form panels, reinforcing walers and a form tie, said lock comprising;

a base plate, mountable on a reinforcing waler on a form panel, having an opening with a peripheral edge for receiving the loop end of a form tie;

attachment means on said base plate for attaching said base plate to the waler;

a post extending from said base plate and spaced from said opening;

a latch member which includes an elongated handle having a proximate end and an extending end for manipulating said latch member, said proximate end being pivotally attached to said post and having a semicircular shaped claw with a tip, said claw extending from one side of said proximate end adjacent said post, said handle being movable from a first unlocked position wherein said claw is spaced from one side of said opening and said extending end is on said one side of said opening, to a closed position whereby said handle swings past center with respect to said post so that said claw extends across said opening to engage a loop end of a form tie and through said opening, and said extending end of said handle on an opposite side of said opening to hold the form tie between the form panels;

a curved curcular portion of said claw having a radius about said post as a center; and an arcuate reinforcing rib in said plate on an opposite side of said opening from said post which is gnerally concentric to said curved portion of said claw and has a radius about said post as a center.

4. A lock, as claimed in claim 3, further including:

a ramp surface formed in said peripheral edge of said second side of said opening for guiding said tip of said claw up onto said plate after said tip passes through the loop end and is deflected thereby toward said opening.

* * * * *